United States Patent [19]

Grotness et al.

[11] 4,132,153

[45] Jan. 2, 1979

[54] METERING CONTROL VALVE AND FLUID POWER SYSTEM

[75] Inventors: Gunnar Grotness; Peter W. Boyer, both of Fort Wayne, Ind.

[73] Assignee: PHD, Inc., Fort Wayne, Ind.

[21] Appl. No.: 739,842

[22] Filed: Nov. 9, 1976

[51] Int. Cl.[2] ..... F15B 15/22; F15B 13/042

[52] U.S. Cl. ..... 91/405; 91/420; 91/443; 91/447; 137/599; 137/625.3

[58] Field of Search ..... 91/443, 447, 405, 420; 137/625.3, 506, 599

[56] References Cited

U.S. PATENT DOCUMENTS

| | | | |
|---|---|---|---|
| 519,436 | 5/1894 | Schweim | 91/443 |
| 3,304,842 | 2/1967 | Shafer | 91/443 |
| 3,906,991 | 9/1975 | Haussler | 91/420 |

FOREIGN PATENT DOCUMENTS

| | | | |
|---|---|---|---|
| 336674 | 4/1959 | Switzerland | 91/447 |

*Primary Examiner*—Paul E. Maslousky
*Attorney, Agent, or Firm*—Gust, Irish, Jeffers & Rickert

[57] ABSTRACT

A fluid power system including a fluid power cylinder having a piston and fluid ports at its opposite ends, a directional valve for selecting the direction of piston actuation, and a metering control valve coupled between the directional valve and the cylinder. The control valve includes a cylinder section having a control piston therein and a valve body connected to the cylinder section and having a valve spool-receiving cavity therein. The valve body has first and second fluid ports therein communicating with the cavity, one of the valve body ports being coupled to one of the power cylinder ports and the other being coupled to the directional valve. A valve spool is disposed in the valve body cavity operatively connected to the control piston and movable therewith, the spool having a passage therein. The spool passage communicates with the valve body ports and provides unrestricted fluid flow therebetween in a first spool position and substantially restricts fluid flow between the valve body ports in a second spool position, movement of the spool between its positions progressively metering the fluid flow between unrestricted and substantially restricted conditions. The spool passage is arranged so that with the spool in one of its positions fluid under pressure entering the passage from one of the valve body ports moves the spool and the control piston in one direction to the other position thereby providing the metering operation. The cylinder section has a port for admitting fluid under pressure thereto so as to move the control piston and spool in the direction opposite the one direction.

33 Claims, 12 Drawing Figures

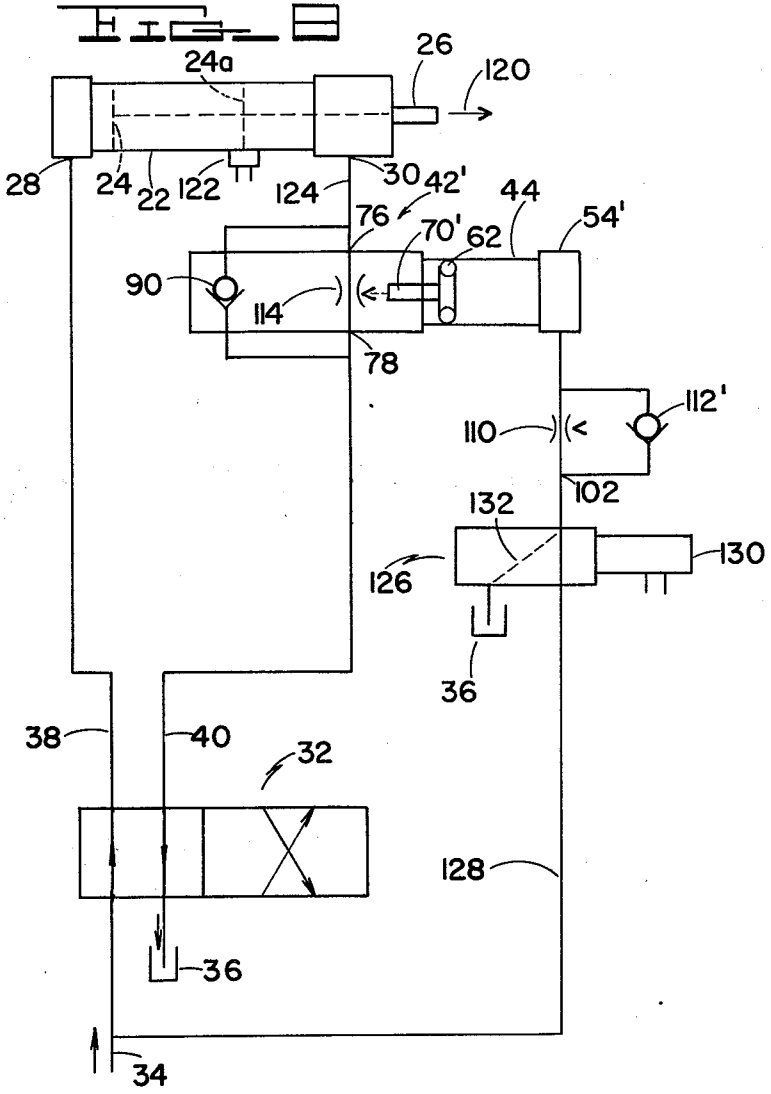
26
120
30
42'
70'
62
44
54'
76
78
124
114
90
24a
122
22
24
28
112'
102
110
130
132
126
36
128
32
40
38
34
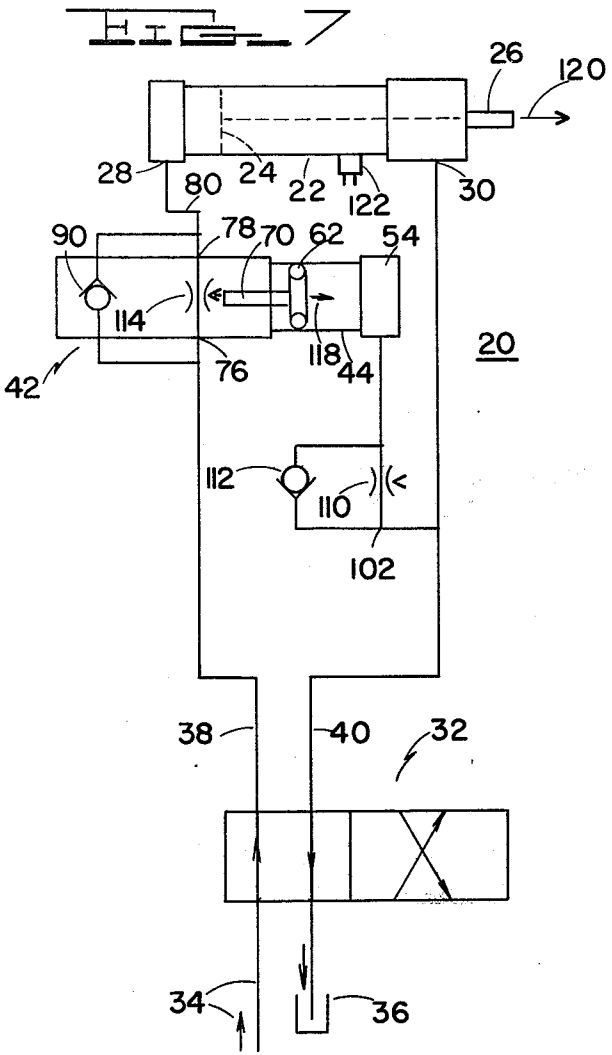
120
26
30
20
54
122
22
24
62
70
78
80
28
114
90
42
76
118
44
110
102
112
32
40
38
36
34

METERING CONTROL VALVE AND FLUID POWER SYSTEM

BACKGROUND OF THE INVENTION

1. Field of the Invention

This invention relates generally to fluid power systems which may include a fluid power device, in which it is desired to have a controlled rate of change of fluid flow, and to metering control valves for use in such systems.

2. Description of the Prior Art

Fluid power cylinders, i.e., hydraulic cylinders, are used as actuators in many applications. Double-acting cylinders which exert force upon both extension and retraction of the piston rod are commonly selectively actuated by a directional valve which applies fluid under pressure to one cylinder port for piston extension and to the other port for piston retraction. A pilot valve actuated by the directional valve is frequently included in the hydraulic system. Various devices have been incorporated in the cylinder for providing a cushioning action at the end of the piston stroke.

There are applications for hydraulic cylinders in which it is desirable to provide acceleration of the piston extension or retraction, other applications in which it is desirable to provide deceleration of the piston extension or retraction, and still other applications in which it is desirable to provide acceleration of the piston at the beginning of its stroke and deceleration at the end of its stroke.

SUMMARY OF THE INVENTION

The present invention finds utility in a fluid power system in which it is desired to have a controlled rate of change of fluid flow which may include a fluid power cylinder having a piston and fluid ports at its opposite ends for admitting fluid under pressure to the cylinder on one side of the piston and discharging fluid from the cylinder on the other side of the piston thereby selectively to actuate the piston in opposite directions, and a directional valve for selecting the direction of piston actuation. In accordance with the broader aspects of the invention, a metering control valve is provided including a cylinder section having a control piston therein and a valve body connected to the cylinder section and having a valve spool-receiving cavity therein, the valve body having first and second axially spaced ports therein communicating with the cavity. One of the valve body ports is coupled to one of the power cylinder ports and the other is coupled to the directional valve for selectively coupling the one valve body port to the source of fluid under pressure and to a sump. A valve spool is disposed in the cavity operatively connected to the control piston and movable therewith between first and second spool positions, the spool having a passage therein extending the direction of spool movement. The spool passage communicates with the valve body ports and provides unrestricted fluid flow therebetween in the first spool position, and substantially restricts fluid flow between the valve body ports in the second spool position, movement of the spool between its positions progressively metering the fluid flow between unrestricted and substantially restricted conditions. The spool passage has a surface arranged so that with the spool in one of its positions, fluid under pressure entering the passage from one of the valve body ports acts on the surface to move the spool and the control piston in one direction to the other spool position. The cylinder section has a port for admitting fluid under pressure thereto thereby to move the control piston and spool in the direction opposite the one direction and for discharging fluid therefrom through metering means when the piston and spool are moved in the one direction.

It is accordingly an object of the invention to provide a control valve for progressively metering fluid flow in a hydraulic system between unrestricted and substantially restricted conditions.

Another object of the invention is to provide a control valve for a hydraulic system in which it is desired to have a controlled rate of change of fluid flow.

A further object of the invention is to provide a control valve for use in connection with a fluid power device such as an accumulator, hydraulic pump, hydraulic motor, hydraulic cylinder or the like which progressively meters fluid flow to the power device thereby to accelerate or decelerate actuation thereof.

A still further object of the invention is to provide a control valve for use in connection with a fluid power cylinder which progressively meters fluid flow from the cylinder thereby to accelerate or decelerate piston movement therein.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 7 is a schematic view of a fluid power system including the fluid power cylinder and the metering control valve of FIG. 1 employed for controlling acceleration of the piston extension;

FIG. 8 is a schematic illustration of a fluid power system including a fluid power cylinder and the metering control valve of FIG. 4 employed for providing controlled deceleration of piston extension;

DESCRIPTION OF THE PREFERRED EMBODIMENTS

Figure 1:
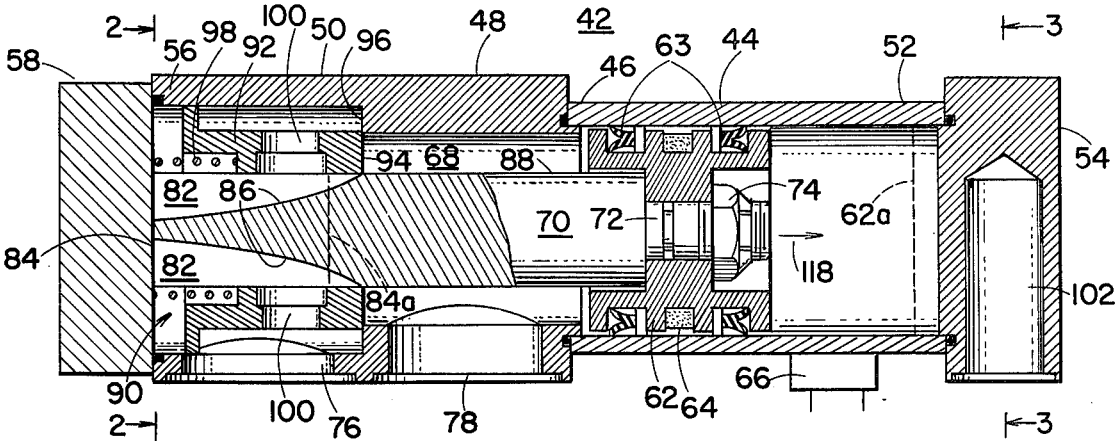
FIG. 1 is a cross-sectional view showing one embodiment of the metering control valve of the invention.
Figure 2:
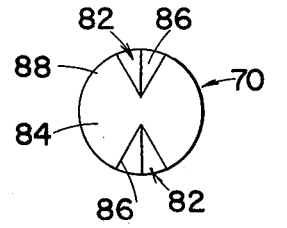
FIG. 2 is an end view of the valve spool of the metering control valve of FIG. 1 as viewed generally along the line 2—2 thereof.

Referring now to FIGS. 1, 2, 3 and 7, an improved fluid power system of the invention, generally indicated at 20, includes an an example of a hydraulically actuable device a fluid power cylinder 22 having piston 24 therein connected to piston rod 26. Cylinder 22 has fluid ports 28, 30 adjacent its opposite ends, respectively, for selectively admitting fluid under pressure to one side of piston 24 and discharging fluid from the otherside thereby selectively to provide extension and retraction of piston 24 and piston rod 26. Conventional directional control valve 32, which may be manually or solenoid-actuated, selectively couples fluid line 34 which is connected to a source of fluid under pressure (not shown) and sump 36 to fluid lines 38, 40.

Metering control valve 42 (FIG. 1) comprises cylinder section 44 having its end 46 connected to end 48 of valve body 50. End 52 of cylinder section 44 is closed by end cap 54 to be hereinafter more fully described. End 56 of valve body 50 is closed by end cap 58 secured with cap screws (not shown). Metering valve 42 is further held in assembled relation by through-bolts 60.

Piston 62 carrying annular lip seals 63 is positioned in cylinder section 44 and is axially movable therein between the position shown in solid lines in FIG. 1 and the position shown in dashed lines at 62*a*. Magnet 64 carried by piston 62 may be used to actuate reed switch 66 mounted on the exterior of cylinder section 44 thereby to indicate the position of piston 62 in cylinder section 44.

Valve body 50 has valve spool cavity 68 therein in which valve spool 70 is positioned. Valve spool 70 is secured to piston 62 by stud 72 having nut 74 threaded thereon. Valve body 50 has fluid ports 76, 78 therein communicating with cavity 68. In the fluid power system 20 of FIG. 7, port 76 is coupled to directional valve 32 by fluid line 38 and port 78 is coupled to port 28 of cylinder 22 by fluid line 80.

Spool 70 (FIG. 1) has passage 82 formed therein extending from end 84 axially toward piston 62. Passage 82 has surface 86 which diverges from end 84 to outer periphery 88. Check valve 90 is provided comprising valve member 92 slidably mounted in valve body 50 and having end wall 94 normally biased into engagement with shoulder 96 of valve body 50 by coil spring 98. Valve member 92 has openings 100 therein communicating with port 76 and spool passages 82.

Figure 3:
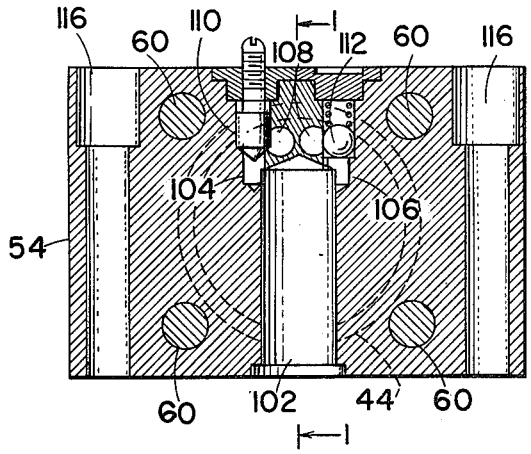
FIG. 3 is a cross-sectional view taken generally along the line 3—3 of FIG. 1.
Figure 5:
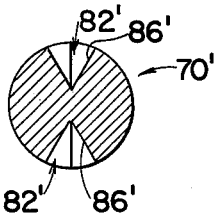
FIG. 5 is a cross-sectional view of the valve spool of the metering control valve of FIG. 4 taken generally along the line 5—5 thereof.
Figure 6:
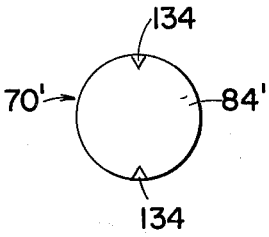
FIG. 6 is an end view of the valve spool of the metering control valve of FIG. 4 as viewed generally along the line 6—6 thereof.

End cap 54 has passage 102 therein communicating with passages 104, 106 which, in turn, respectively communicate with ports 108 which communicate with cylinder section 44 at end 52 thereof. Passage 104 has selectively adjustable metering needle valve 110 therein and passage 106 has ball check valve 112 therein, as best seen in FIG. 3. In FIG. 7, needle valve 110 and ball check valve 112 are schematically shown exteriorly connected to end cap 54. Passage 102 is coupled to line 40 which couples directional valve 32 to cylinder port 30. Valve spool 70 with passage 82 forms metering needle valve 114 (FIG. 7) with ports 76, 78. Openings 116 and similar openings in end cap 58 (not shown) serve to secure metering control valve 42 to a mounting surface (not shown).

It will now be assumed that directional valve 32 is actuated to connect pressure line 34 to line 40 and port 30 of cylinder 22, and to connect line 80, ports 78, 76 of metering control valve 42, and line 38 to sump 36. In this condition, fluid under pressure will be applied to port 30 of cylinder 22 thereby tending to move piston 24 and piston rod 26 to the left, as viewed in schematic 20, to the position shown in dashed lines in FIG. 7. Fluid under pressure from line 40 will also be passed through needle valve 110 and ball check valve 112 into cylinder section 44 of metering control valve 42 thereby to move piston 62 and spool 70 to the left, as viewed in FIG. 1, to the position shown in solid lines in FIG. 1 in which spool 70 substantially restricts fluid flow between ports 78, 76. However, fluid under pressure in line 80 caused by movement of piston 24 toward the left acts on wall 94 of valve member 92 to move it to the left, as viewed in FIG. 1, against the force exerted by spring 98 thereby moving wall 94 out of engagement with shoulder 96 of valve body 50 to provide unrestricted fluid flow between port 78 and port 76 so as to provide for rapid discharge of fluid from cylinder 22 to sump 36.

It will now be assumed that directional valve 32 is actuated to connect pressure line 34 to line 38 and sump 36 to line 40, as shown in solid lines in FIG. 7. Spring 98 will thus return valve member 92 to its position shown in FIG. 1 with wall 94 engaging shoulder 96 of valve body 50. Fluid under pressure in line 38 is thus applied to port 76 and opening 100 in valve member 92 and acts on surface 88 of passage 82 thereby to move spool 70 and piston 62 toward the right, as shown by arrow 118 in FIG. 1. Fluid in cylinder section 44 is exhausted to sump 36 under the control of needle valve 110, thus metering the rate of movement of piston 62 and spool 70 in direction 118. As spool 70 is moved in direction 118, it will be observed that passage 82 provides communication between ports 76 and 78 thus providing for fluid flow therebetween and to line 80 and port 28 of cylinder 22, thereby to initiate extension of piston rod 26 in the direction shown by arrow 120. It will be observed that as piston 62 and spool 70 are moved in direction 118 under the control of metering valve 110, that the cross-sectional area of passage 82 through which fluid is flowing from opening 100 to port 78 is progressively increased, thus progressively increasing the rate of fluid flow between ports 76, 78. This progressive increase in the rate of fluid flow between ports 76, 78 as piston 62 and spool 70 are moved in direction 118 results in progressive increase in the rate of fluid flow applied to port 28 of cylinder 22 thus accelerating extension of piston rod 26 in direction 120. As piston 24, cylinder 22 nears the end of its extension stroke, its position may be sensed by reed switch 122 coupled to actuate directional valve 32 to its neutral position thereby to terminate extension of piston rod 26.

Referring now to FIGS. 4, 5, 6 and 8, in which like elements are indicated by like reference numerals and similar elements by primed reference numerals, valve spool 70′ has passage 82′ therein respectively having surface 86′, as shown. Here, line 38 from directional valve 32 is coupled directly to port 28 of cylinder 22, line 40 is coupled to port 78 of metering control valve 42′, and port 76 is coupled to port 30 of cylinder 22 by fluid line 124. Solenoid-actuated three-way valve 126 is provided coupled to passage 102 in end cap 54 of metering control valve 42′ and coupled by fluid line 128 to pressure line 34. Solenoid 130 of valve 126 is energized by reed switch 122 on cylinder 22. Valve 126 normally couples passage 120 to pressure line 34, as shown in solid lines in FIG. 8. Upon energization of solenoid 130, valve 126 couples passage 102 to sump 36, as shown by dashed line 132 in FIG. 8.

Figure 4:
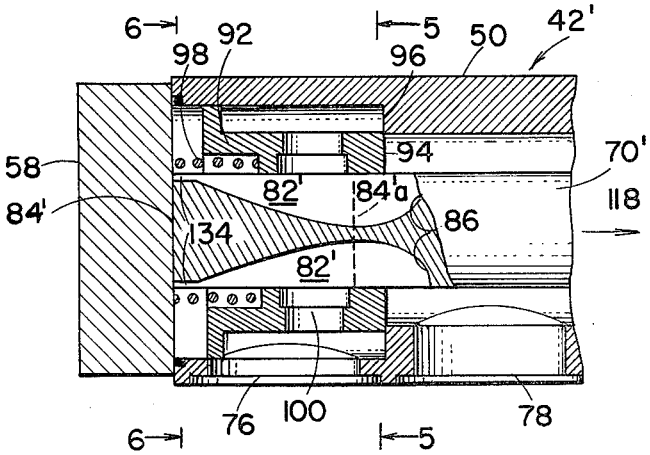
FIG. 4 is a fragmentary cross-sectional view showing another embodiment of the metering control valve of the invention.

It will be observed that with spool 70' of metering control valve 42' in its position shown in solid lines in FIG. 4, passage 82' provides unrestricted fluid flow between port 76 and port 78. It will further be seen that when valve spool 70' is moved to the position shown in dashed lines 84a' in FIG. 4, fluid flow between port 76, 78 is substantially restricted with, however, restricted by-pass flow between ports 76, 78 being provided by grooves 134.

Assuming now that piston 24 and piston rod 26 of cylinder 22 and piston 62 and valve spool 70' of metering control valve 42' are positioned as shown in FIGS. 4 and 8, it will be assumed that directional valve 32 is actuated to connect pressure line 34 to fluid line 38 and to connect fluid line 40 to sump 36, as shown in solid lines in FIG. 8. Fluid under pressure is thus supplied to port 28 of cylinder 22 thereby forcing piston 24 and piston rod 26 toward the right, as shown by arrow 120, fluid being discharged from cylinder 22 through port 30 and line 124, through port 76, passage 82' and port 78 of metering control valve 42', and through line 40 and directional valve 32 to sump 36. Meanwhile, fluid under pressure from line 34 is applied by line 128 through valve 126, needle valve 110 and check valve 112' to cylinder section 44 thereby to maintain piston 62 and spool 70' in the position shown in FIG. 4.

Arrival of piston 24 of cylinder 22 at position 24a, as shown in FIG. 8, is sensed by reed switch 122 which is coupled to solenoid 130 of valve 126 and thus actuates the same to connect passage 102 of end cap 54 to sump 36. Fluid pressure is thus removed from piston 62 in cylinder section 44, and the fluid in cylinder section 44 is now discharged to sump 36 through valve 126 and metering needle valve 110. It will be observed that fluid under pressure from piston 24 of cylinder 22 is applied to port 76, opening 100 and passage 82' of metering control group valve 42' and now exerts force on surface 86 to move spool 70' and piston 62 in direction 118 under the control of needle valve 110. As spool 70' moves in direction 118, it will be observed the cross-sectional area of passage 82' exposed to opening 100 and port 76 is progressively reducing the rate of fluid flow between ports 76, 78 in turn progressively reducing the rate of discharge of fluid from port 30 of cylinder 22 thereby progressively decelerating the extension of piston rod 26 in direction 120.

Figure 9:
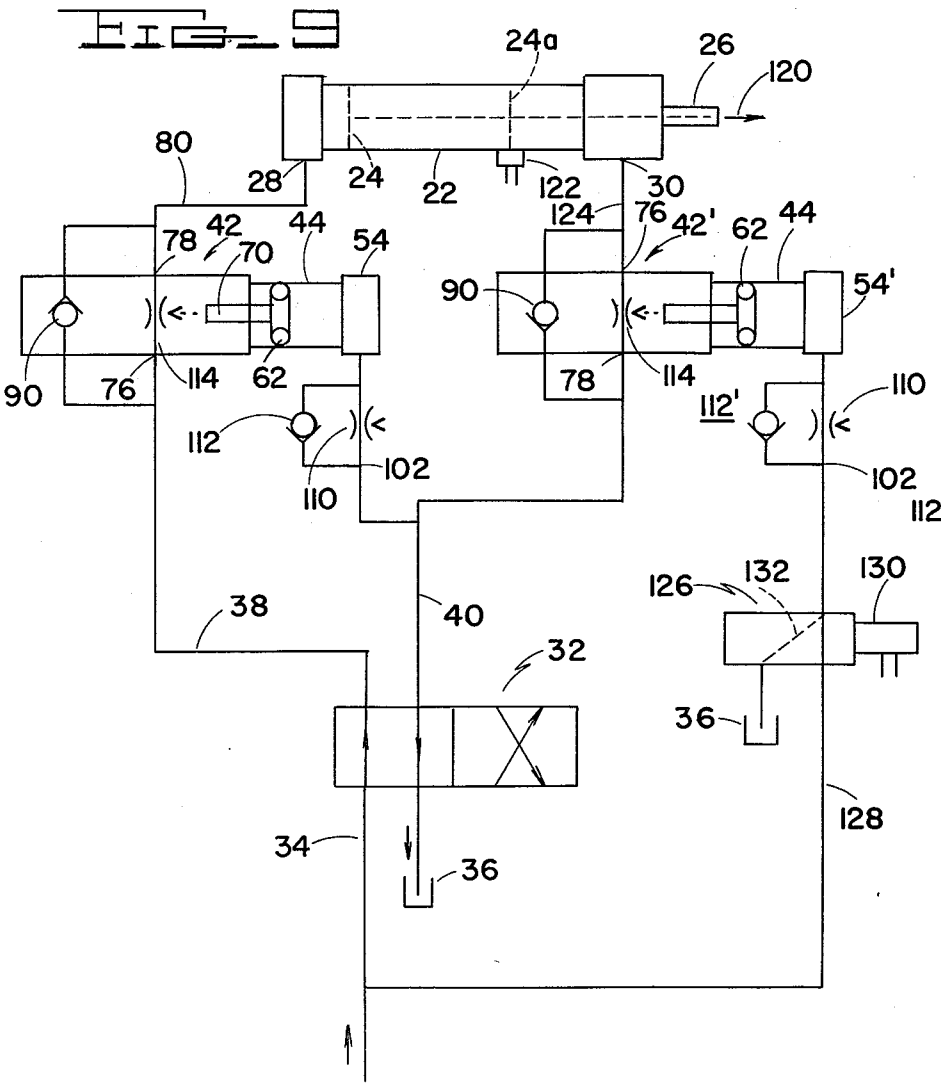
FIG. 9 is a schematic illustration of a fluid power system including a fluid power cylinder and the metering control valves of FIGS. 1 and 4 employed for providing controlled acceleration and deceleration of piston extension.

Referring now to FIG. 9, one metering control valve 42 and another metering control valve 42' may be coupled to cylinder 22, metering control valve 42 being coupled as shown in FIG. 7 and functioning as described above to provide controlled acceleration of extension of piston rod 26 in direction 120, and metering control valve 42' being coupled as shown in FIG. 8 and functioning as described above to provide controlled deceleration of the extension of piston rod 26.

Figure 11:
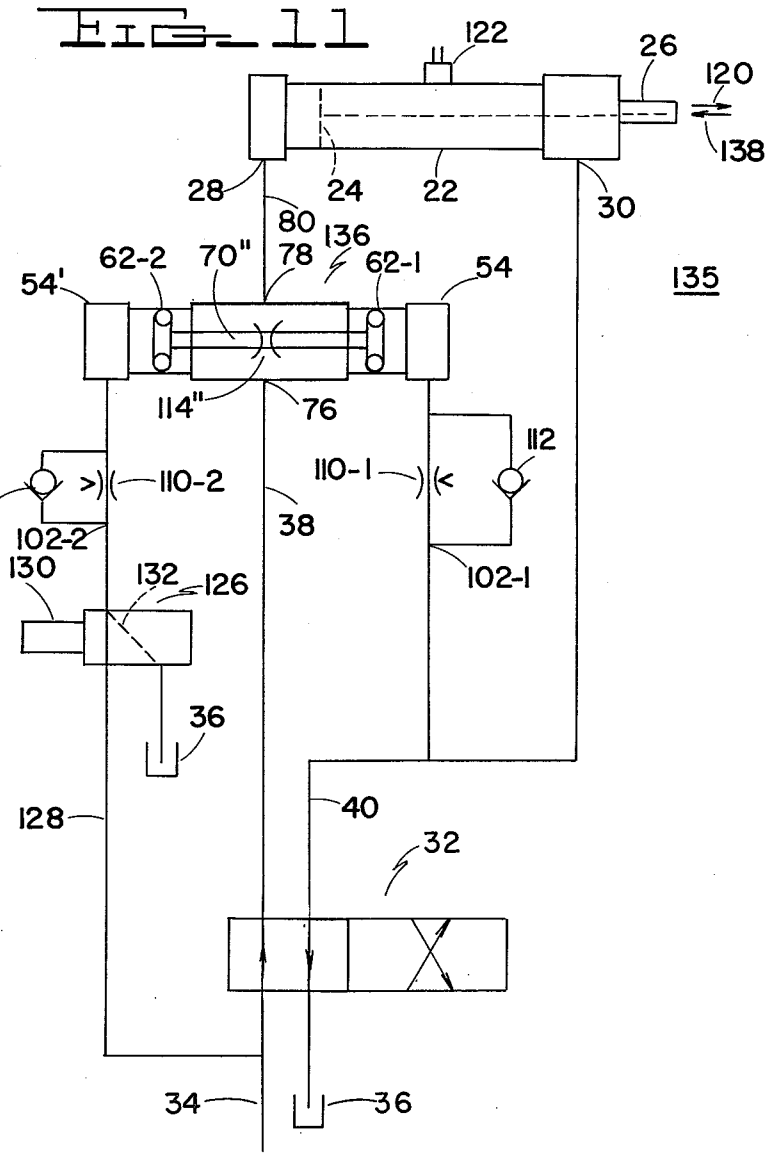
FIG. 11 is a schematic illustration of a fluid power system including a fluid power cylinder and the metering control valve of FIG. 10 employed to provide acceleration of piston extension and deceleration of piston retraction.
Figure 10:
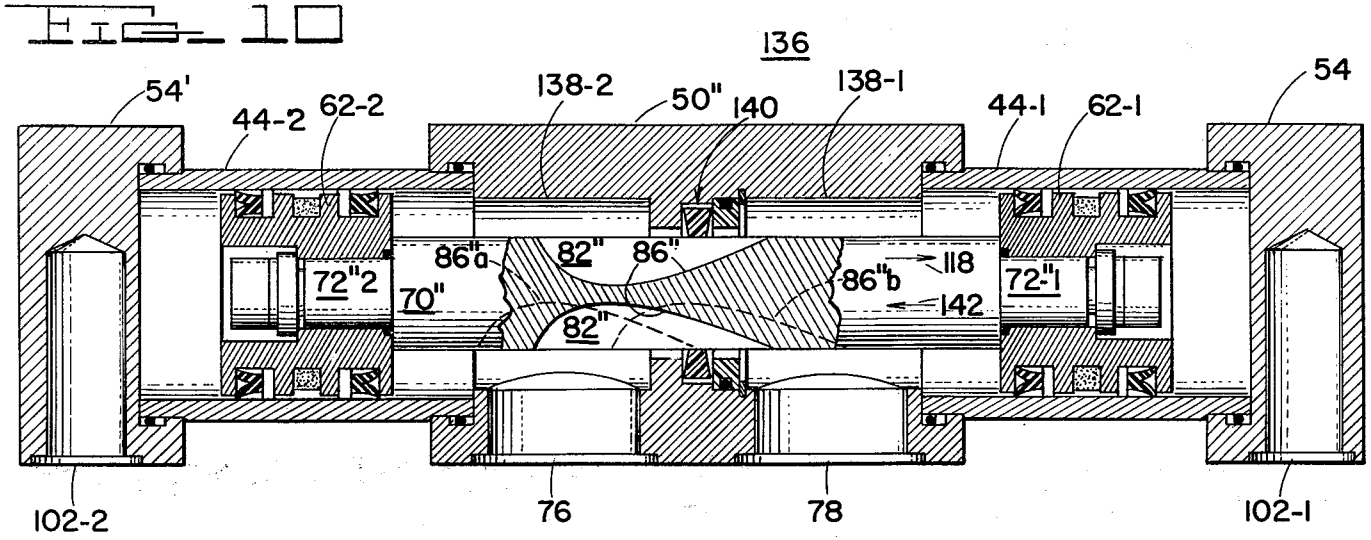
FIG. 10 is a cross-sectional view showing another embodiment of the metering control valve of the invention.

Referring now to FIGS. 10 and 11, in which like elements are again indicated by like reference numerals and similar elements by doubled primed reference numerals, there is shown a fluid power system, generally indicated at 135, employing a double-acting metering control valve 136 which provides acceleration of the extension of piston rod 26 in direction 120 and deceleration of retraction of piston rod 26 in direction 138. Metering control valve 136 comprises valve body 50" connected at its opposite ends to first and second cylinder sections 44-1 and 44-2. Valve body 50" has valve spool cavity 138 therein which receives double-acting valve spool 70".

Spool 70" is connected at one end to piston 62-1 in cylinder section 44-1, and at its other end to piston 62-2 in cylinder section 44-2. Cylinder section 44-1 is closed by end cap 54 and cylinder section 44-2 is closed by end cap 54'. Ports 76, 78 communicate with spool cavity 138. Sealing assembly 140 on valve body 50" cooperates with spool 70" to divide spool cavity 138 into two sections 138-1 and 138-2. Spool 70" has passage 82" therein having surface 86".

Valve spool 70" is shown midway between its two positions in FIG. 10. It will be seen that with valve spool 70" moved to its right position, passage 82" will provide unrestricted fluid flow between ports 76, 78, as shown in dashed lines at 86"b whereas, with spool 70" in its left position, spool 70" substantially restricts fluid flow between ports 76, 78, as shown in dashed lines at 86"a. End caps 54, 54' are provided with needle valves 110 and check valves 112, 112' as described above in connection with the embodiments of FIGS. 1 and 4.

It will be seen that directional valve 32 selectively connects fluid pressure line 34 and sump 36 to fluid lines 38, 40. Line 38 is coupled to port 76 of metering control valve 136 and fluid line 80 connects ports 78 to port 28 of cylinder 22. Fluid line 40 is connected to port 30 of cylinder 22 and to passage 102-1 of end cap 54. Passage 102-2 of end cap 54' is coupled to three-way valve 126 which, in turn, is coupled to pressure line 34 by line 128.

Assuming now that piston 24 of cylinder 22 and piston rod 26 are in the retracted position, as shown in FIG. 11, and that valve spool 70" is in its left position thereby blocking fluid flow between ports 76 and 78, actuation of directional valve 32 to couple line 38 to pressure line 34 and line 40 to sump 36 will result in application of fluid under pressure to port 76 and passage 82" and on piston 62-2 to move spool 70" to the right, as shown by arrow 118, movement of piston 62-1 in cylinder section 44-1 discharging fluid through metering valve 110-1 thus controlling the rate of movement of piston 62-1 and spool 70" in direction 118. This movement of spool 70" moves passage 82" to the right thereby providing fluid flow between ports 76, 78 at a progressively increasing rate, as above described, thereby moving piston 24 and piston rod 26 of cylinder 22 in direction 120 at a progressively accelerated rate.

Assume now that piston 24 and piston rod 26 are in their extended position and that spool 70" of metering control valve 136 is in its right position, actuation of directional valve 32 to couple line 40 to pressure line 34 and line 38 to sump 36 initiates retraction of piston 24 and piston rod 26 in direction 138, fluid being discharged from cylinder 22 through metering control valve 136 by reason of passage 82" providing unrestricted fluid flow between ports 78, 76, it being observed that three-way valve 126 couples pressure line 34 to end cap 54' through needle valve 110-2 and check valve 112' thus maintaining piston 62-2 and spool 70" in their right position. When piston 24 of cylinder 22 reaches reed switch 122, valve 126 is actuated to couple passage 102-2 of end cap 54' to sump 36 thus permitting pistons 62-1 and 62-2 to move to the left and cylinder section 44-2 with fluid being discharged therefrom through needle valve 110-2. The fluid under pressure in line 80 discharged by movement of piston 24 of cylinder 22 in direction 138 flows through passage 82", spool 70" moving to the left under the control of needle valve 110-2 and fluid pressure applied to piston 62-1, as shown by arrow 142, leftward movement of passage 82" toward its position 86" a progressively restricting fluid flow between ports 78 and 76 thereby decelerating retraction of piston 24 and piston rod 26 in direction 138.

Figure 12:
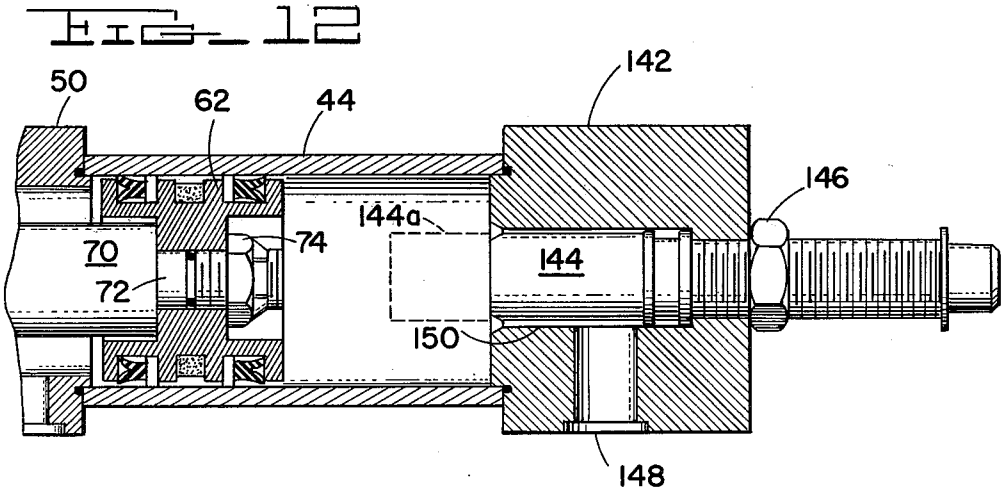
FIG. 12 is a fragmentary cross-sectional view showing a further embodiment of the metering control valve of the invention.

Referring now to FIG. 12, in which like elements are still indicated by like reference numerals, end cap 54 of the previous embodiments may be replaced by end cap 142 having stud 144 threaded therein and retained in any selected position by nut 146. Stud 144 is thereby selectively movable between a fully retracted position, as shown in solid lines in FIG. 12, and an extended position in cylinder section 44, as shown in dashed lines at 144*a*. Stud 144 in a selected extended position 144*a* thus functions as a stop to limit movement of piston 62 in cylinder section 44. Passage 148 in end cap 142 communicates with passage 150 surrounding stud 144. In this embodiment, needle valve 110 and check valve 112 or 112' are externally coupled to passage 148.

While the metering valve of this invention is disclosed more specifically in a system utilizing a power cylinder, it will be understood by a person skilled in the art that it may be used in systems incorporating, by way of example, an accumulator, hydraulic motor, hydraulic pump or similar device. Also it will be apparent that the metering valve may be used in any hydraulic system in which it is desired to have a controlled rate of change of fluid flow either increasing or decreasing. Therefore this invention is not to be construed as limited to systems incorporating hydraulic cylinders only.

While there have been described above the principles of this invention in connection with specific apparatus, it is to be clearly under stood that this description is made only by way of example and not as a limitation to the scope of the invention.

What is claimed is:

1. In a fluid power system wherein changes in flow rate may occur, said system including a hydraulically actuable device having first and second ports each functioning as inlet and outlet ports, respectively, and a directional valve for selecting the direction of actuation of said hydraulically actuable device: a metering control valve including a cylinder section having a control piston therein; a valve body connected to said cylinder section and having a valve spool-receiving cavity therein, said valve body having first and second axially spaced ports therein communicating with said cavity, one of said valve body ports being coupled to one of said ports of said hydraulically actuable device and the other of said valve body ports being coupled to said directional valve for selectively coupling said other valve body port to a source of fluid under pressure and a sump; a valve spool in said cavity operatively connected to said control piston and movable therewith between first and second spool positions, said spool having a passage therein extending in the direction of spool movement, said passage communicating with said valve body ports and providing unrestricted fluid flow therebetween in said first spool position, said spool substantially restricting fluid flow between said valve body ports in said second spool position, movement of said spool between said positions thereof progressively metering said fluid flow between unrestricted and substantially restricted conditions, said passage having a surface arranged so that with said spool in one of said positions thereof fluid under pressure entering said passage from one of said valve body ports acts on said surface thereby moving said spool and control piston in one direction to the other of said positions thereof; said cylinder section having a control cylinder port for admitting fluid under pressure thereto thereby to move said control piston and spool in the direction opposite said one direction and for discharging fluid therefrom when said piston and spool are moved in said one direction; and means for metering fluid discharged from said control cylinder port thereby controlling movement of said control piston and spool in said one direction.

2. In the system of claim 1 wherein said valve body has a bypass valve therein coupling on valve body port and the other of said valve body ports and bypassing said spool, said bypass valve being normally closed and being opened in response to application of fluid under pressure to one of said valve body ports thereby providing unrestricted flow of fluid between said valve body ports.

3. The system of claim 2 wherein said valve body has a passage therein connecting said valve body ports, said bypass valve comprising a member movable between first and second positions in said valve body passage and having an opening therein communicating with said last-named one port and spool passage, said member in said first position thereof blocking fluid flow through said valve body passage between said valve body ports, said member in said second position thereof opening said valve body passage to unrestricted fluid flow between said valve body ports, and spring means normally biasing said member to said first position thereof, said member having a surface acted on by fluid under pressure in said last-named other valve body port thereby moving said member to said second position thereof.

4. The system of claim 1 wherein said metering means comprises a metering valve, and further comprising a check valve in parallel with said metering valve and coupled to said cylinder section port.

5. The system of claim 4 wherein one of said ports of said hydraulically actuable device is coupled to said directional valve for selectively coupling said last-mentioned port to said source and said sump.

6. The system of claim 5 wherein said metering valve and check valve are coupled to said last-mentioned port and directional valve.

7. The system of claim 5 further comprising another valve for selectively coupling said metering valve and check valve to said source and said sump.

8. The system of claim 7 wherein said hydraulically actuable device includes a power cylinder having a piston and with said first and second ports at its opposite ends, respectively, for admitting fluid under pressure to said cylinder on one side of said piston and discharging fluid from said cylinder on the other side of said piston thereby selectively to actuate said piston in opposite directions and wherein said other valve normally couples said metering and check valves to said source, and further comprising means for actuating said other valve to couple said metering and check valves to said sump in response to predetermined movement of said cylinder piston toward one cylinder port.

9. The system of claim 8 wherein said valve body has a bypass valve therein coupling said last-named one valve body port and the other of said valve body ports and bypassing said spool, said bypass valve being normally closed and being opened in response to application of fluid under pressure to said last-named other valve body port thereby providing unrestricted flow of fluid between said valve body ports.

10. The system of claim 5 wherein said metering valve and check valve are coupled to said one power port of said hydraulically actuable device and directional valve, said valve body having a bypass valve therein coupling said one valve body port and the other of said valve body ports and bypassing said spool, said bypass valve being normally closed and being opened in response to application of fluid under pressure to one valve body port thereby providing unrestricted flow of fluid between said valve body ports.

11. The system of claim 1 wherein said spool passage has opposite ends, the cross-sectional area of said passage progressively increasing from one of said ends toward the other.

12. The system of claim 11 wherein said hydraulically actuable device includes a power cylinder having a piston and with said first and second cylinder ports being at its opposite ends, respectively, for admitting fluid under pressure to said cylinder on one side of said piston and discharging fluid from said cylinder on the other side of said piston thereby selectively to actuate said piston in opposite directions and wherein admission of fluid under pressure to one cylinder port causes movement of said cylinder piston toward the other cylinder port, said spool movement in said one direction being toward said first spool position whereby movement of said cylinder piston toward said other cylinder port is progressively accelerated.

13. The system of claim 11 wherein said spool movement in said one direction is toward said second spool position whereby movement of said cylinder piston responsive to fluid flow through said metering valve is progressively decelerated.

14. The system of claim 11 wherein said hydraulically actuable device has a piston element movable in opposite directions in response to pressure fluid alternately applied to the ports thereof, said fist port being coupled to said directional valve whereby actuation of said directional valve to apply fluid under pressure to said other port causes discharge of fluid under pressure from said one port through said metering control valve to said sump, and further comprising another valve for selectively coupling said cylinder section port to said source and sump, said other valve normally coupling said cylinder section port to said source, and further comprising means for actuating said other valve to couple said cylinder section port to said sump in response to movement of said piston element toward said other port to a predetermined position, said spool movement in said opposite direction being toward said second spool position whereby movement of said piston element toward said other port is responsive to unrestricted fluid flow prior to arrival at said predetermined position and thereafter is progressively decelerated.

15. The system of claim 14 wherein said one port is coupled to said directional valve by a second metering control valve substantially identical to said first-named metering control valve except the spool movement thereof in said one direction is toward said first spool position whereby movement of said piston element away from said one port to said predetermined position is progressively decelerated.

16. The system of claim 13 wherein said spool has fluid metering grooves arranged to restrict fluid flow between said valve body ports when said spool is in said second position thereof.

17. In a fluid power system wherein changes in flow rate may occur, said system including a hydraulically actuable device having first and second ports each functioning as inlet and outlet ports, respectively, and a directional valve for selecting the direction of actuation of said hydraulically actuable device: a metering control valve including a cylinder section having a control piston therein; a valve body connected to said cylinder section and having a valve spoolreceiving cavity therein, said valve body having first and second axially spaced ports therein communicating with said cavity, one of said valve body ports being coupled to one of said ports of said hydraulically actuable device and the other of said valve body ports being coupled to said directional valve for selectively coupling said other valve body port to a source of fluid under pressure and a sump; a valve spool in said cavity operatively connected to said control piston and movable therewith between first and second spool positions, said spool having a passage therein extending in the direction of spool movement, said passage communicating with said valve body ports and providing unrestricted fluid flow therebetween in said first spool position, said spool substantially restricting fluid flow between said valve body ports in said second spool position, movement of said spool between said positions thereof progressively metering said fluid, flow between unrestricted and substantially restricted conditions, said passage having a surface arranged so that with said spool in one of said positions thereof fluid under pressure entering said passage from one of said valve body ports acts on said surface thereby moving said spool and control piston in one direction to the other of said positions thereof; said cylinder section having a control cylinder port for admitting fluid under pressure thereto thereby to move said control piston and spool in the direction opposite said one direction and for discharging fluid therefrom when said piston and spool are moved in said one direction; means for metering fluid discharged from said control cylinder port thereby controlling movement of said control piston and spool in said one direction, said valve body and spool respectively have opposite ends, said cylinder section being connected to one of said valve body ends, said control piston being connected to one of said spool ends, and further comprising a second cylinder section connected to the other of said valve body ends and having a second control piston therein operatively connected to the other of said spool ends, said valve body ports being intermediate said valve body ends, said spool passage being intermediate said spool ends, said passage having a second surface arranged so that with said spool in the other of said positions thereof fluid under pressure entering said passage from the other of said valve body ports acts on said second surface thereby moving said spool and control piston in the other direction to said one position thereof, said second cylinder section having a port for admitting fluid under pressure thereto thereby to move said second control piston and spool in said one direction and for discharging fluid therefrom when said second control piston and spool are moved in said other direction, said second cylinder section port being coupled to said directional valve and other cylinder port, said second cylinder section having means for metering fluid discharged therefrom.

18. The system of claim 1 wherein said cylinder section has opposite ends, one of said ends being connected to said valve body, and further comprising an end member closing the other end of said cylinder section, and an adjusting member threadedly secured to said end member and extending into said cylinder section for selectively limiting movement of said control piston and spool in said one direction.

19. A metering valve for controlling fluid flow from a source of fluid under pressure comprising: a cylinder having a piston therein; a valve body connected to said cylinder and having a valve spool-receiving cavity therein, said valve body having first and second spaced ports therein communicating with said cavity and adapted to be coupled in a fluid line; a valve spool in said cavity operatively connected to said piston and movable therewith between first and second spool positions, said spool having a passage therein extending in the direction of spool movement, said passage communicating with said ports and providing unrestricted fluid flow therebetween in said first spool position, said spool substantially restricting fluid flow between said ports in said second spool position, movement of said spool between said positions thereof progressively metering said fluid flow between unrestricted and substantially restricted conditions, said passage having a surface arranged so that with said spool in one of said positions thereof fluid under pressure entering said passage from one of said ports acts on said surface thereby moving said spool and piston in one direction to the other of said positions thereof; said cylinder having a port for admitting fluid under pressure thereto thereby to move said piston and spool in the direction opposite said one direction and for discharging fluid therefrom; and means for metering fluid discharged from said control cylinder port thereby controlling movement of said control piston and spool in said one direction.

20. The valve of claim 19 wherein said valve body has a bypass valve therein coupling said one valve body port and the other valve body port and bypassing said spool, said bypass valve being normally closed and being opened in response to application of fluid under pressure to said other valve body port thereby providing unrestricted fluid flow between said ports.

21. The valve of claim 20 wherein said valve body has a passage therein connecting said valve body ports, said bypass valve comprising a member movable between first and second positions in said valve body passage and having an opening therein communicating with said last-named one port and spool passage, said member in said second position thereof opening said valve body passage for unrestricted fluid flow between said valve body ports, and spring means normally biasing said member to said first position thereof, said member having a surface acted on by fluid under pressure in said last-named other valve body port thereby moving said member to said second position thereof.

22. The valve of claim 19 wherein said metering means comprises a metering valve, and further comprising a check valve in parallel with said metering valve and coupled to said cylinder section port.

23. The valve of claim 19 wherein said spool passage has opposite ends, the cross-sectional area of said passage progressively increasing in a direction from one of said ends toward the other.

24. The valve of claim 23 wherein said spool movement in said one direction is toward said first spool position whereby said fluid flow is progressively metered from said restricted to said unrestricted condition.

25. The valve of claim 23 wherein said spool movement in said one direction is toward said second spool position whereby said fluid flow is progressively metered from said unrestricted to said restricted condition.

26. The valve of claim 25 wherein said spool has fluid metering grooves therein arranged to restrict fluid flow between said cylinder section ports when said spool is in said second position thereof.

27. A metering valve for controlling fluid flow from a source of fluid under pressure comprising: a cylinder having a piston therein; a valve body connected to said cylinder and having a valve spool-receiving cavity therein, said valve body having first and second spaced ports therein communicating with said cavity and adapted to be coupled in a fluid line; a valve spool in said cavity operatively connected to said piston and movable therewith between first and second spool positions, said spool having a passage therein extending in the direction of spool movement which varies in cross-section from one end to the other thereof, said passage communicating with said ports and providing unrestricted fluid flow therebetween in said first spool position, said spool substantially restricting fluid flow between said ports in said second spool position, movement of said spool between said positions thereof progressively metering and fluid flow between unrestricted and substantially restricted conditions; said cylinder section having a port for admitting fluid under pressure thereto thereby to move said piston and spool in the direction opposite said one direction and for discharging fluid therefrom; and means for metering fluid discharged from said control cylinder port thereby controlling movement of said control piston and spool in said one direction.

28. The valve of claim 27 wherein said valve body and spool respectively have opposite ends, said cylinder section being connected to one of said valve body ends, said piston being connected to one of said spool ends, and further comprising a second cylinder section connected to the other of said cylinder ends and having a second piston therein operatively connected to the other of said spool ends, said ports being intermediate said ends thereof, said spool passage being intermediate said ends thereof, said passage having a second surface arranged so that with said spool in the other of said positions thereof fluid under pressure entering said passage from the other of said ports acts on said second surface thereby moving said spool and piston in the other direction to said one position thereof, said second cylinder section having a port for admitting fluid under pressure thereto thereby to move said second piston and spool in said one direction and for discharging fluid therefrom when said second piston and spool are moved in said other direction; said second cylinder section having means for metering fluid discharged therefrom.

29. The valve of claim 27 wherein said valve body has a bypass valve therein coupling said one valve body port and the other valve body port and bypassing said spool, said bypass valve being normally closed and being opened in response to application of fluid under pressure to said other valve body port thereby providing unrestricted fluid flow between said ports.

30. The valve of claim 29 wherein said valve body has a passage therein connecting said valve body ports, said bypass valve comprising a member movable between first and second positions in said valve body passage and having an opening therein communicating with said last-named one port and spool passage, said member in said second position thereof opening said valve body passage for unrestricted fluid flow between said ports, and spring means normally biasing said member to said first position thereof, said member having a surface acted on by fluid under pressure in said last-named other port thereby moving said member to said second position thereof.

31. The valve of claim 27 wherein said metering means comprises a metering valve, and further comprising a check valve in parallel with said metering valve and coupled to said cylinder section port.

32. The valve of claim 27 wherein said spool passage has opposite ends, the cross-sectional area of said passage progressively increasing from one of said ends toward the other.

33. The valve of claim 32 wherein said spool movement in said one direction is toward said first spool position whereby said fluid flow is progressively metered from said restricted to said unrestricted condition.

* * * * *

UNITED STATES PATENT AND TRADEMARK OFFICE

CERTIFICATE OF CORRECTION

PATENT NO. : 4,132,153

DATED : January 2, 1979

INVENTOR(S) : Gunnar Grotness, Peter W. Boyer

It is certified that error appears in the above–identified patent and that said Letters Patent are hereby corrected as shown below:

Col. 5, line 3, "120" should be --102--.
Col. 7, line 6, "86'' a" should be --86''a--.

Claim 2, col. 8, line 15, "on" should be --one--.
Claim 14, col. 9, line 40, "fist" should be --first--.
Claim 16, col. 9, line 67, after "wherein" insert --the passage in--; delete "has" and before "fluid" add --is in the form of--.
Claim 27, col. 12, line 28, "and" should be --said--.
Claim 29, col. 12, line 64, before "ports" insert --valve body--.

Signed and Sealed this

*Twenty-sixth* Day of *February 1980*

[SEAL]

*Attest:*

SIDNEY A. DIAMOND

*Attesting Officer*

*Commissioner of Patents and Trademarks*